United States Patent [19]

French

[11] Patent Number: 4,467,831

[45] Date of Patent: Aug. 28, 1984

[54] FLUID-LOGIC THYRISTOR

[76] Inventor: George F. French, 4009 Linden St., Oakland, Calif. 94608

[21] Appl. No.: 202,125

[22] Filed: Oct. 30, 1980

Related U.S. Application Data

[63] Continuation of Ser. No. 971,539, Dec. 20, 1978, abandoned.

[51] Int. Cl.[3] ..... F15B 13/04

[52] U.S. Cl. ..... 137/625.27; 417/40; 417/128; 417/131

[58] Field of Search ..... 137/625.27, 625.5; 417/40, 128, 131

[56] References Cited

U.S. PATENT DOCUMENTS

| | | | |
|---|---|---|---|
| 629,577 | 7/1899 | Luhn | 417/131 |
| 1,056,709 | 3/1913 | Pollacek et al. | 417/131 X |
| 1,161,999 | 11/1915 | Trumble | 417/131 |
| 1,296,524 | 3/1919 | Jay | 417/131 |
| 1,756,895 | 4/1930 | Wheeler | 417/131 |
| 2,192,200 | 3/1940 | Page | 417/131 X |
| 3,138,113 | 6/1964 | Arutunoff | 417/131 X |
| 4,025,237 | 5/1977 | French | 417/131 |

FOREIGN PATENT DOCUMENTS

| | | | |
|---|---|---|---|
| 400748 | 1/1974 | U.S.S.R. | 137/625.27 |

*Primary Examiner*—Gerald A. Michalsky

*Attorney, Agent, or Firm*—Schapp and Hatch

[57] ABSTRACT

A hybrid gate-controlled three-way valving device that because of its regenerative-feedback-induced bistable action is a fluid-logic analogue of the electronic thyristor. The device is more particularly analogous to a common electronic thyristor known as the silicon controlled rectifier (SCR) because each is a switching device that in its normal state blocks forward conduction of the control-agent fluid, but which upon receipt at a control gate of an appropriate signal will trigger full forward conduction of the control-agent fluid. Each is moreover a device wherein such full forward conduction, once triggered by a brief signal, will continue even after the signal has been removed, until the control-agent supply flow has been cut off, reduced or reversed.

In an actual circuit, the fluid-logic thyristor functions typically as a three-way pneumatic valve which in its normal blocked state has zero forward conduction (cylinder is blocked to supply but open to exhaust), but which can be actuated and latched into full forward conduction (cylinder is open to supply, blocked to exhaust) by means of a single force pulse mechanically delivered to one of the two control gates. Such forward conduction will continue even after the force pulse is discontinued and can normally be stopped only if an opposite mechanical force pulse is delivered to one of the two control gates. (See accompanying glossary).

2 Claims, 11 Drawing Figures

FLUID-LOGIC THYRISTOR

This is a continuation, of application, Ser. No. 971,539, filed Dec. 20, 1978, now abandoned.

BACKGROUND OF THE INVENTION

Broad application of fluid-logic systems to date has not been practicable because of the following limitations in existent hardware:

1. Available devices dissipate a relatively high percentage of their power in continuous bleed-off or exhaust;
2. They operate at such low pressures that line losses become drastically significant: additional elements and connecting plumbing compel new circuit analysis and pressure-drop allowance.
3. Again because of these low pressures (typically a few inches of water pressure), these devices are not normally capable of performing useful work and must be supplemented by separate output interface devices to develop enough power to get jobs done.
4. Many industrial users have had difficulty in meeting the fluid-logic system requirement for clean, dry air that low-pressure, small-orifice devices demand—with the result that such systems would prematurely fail.
5. Practically all the fluid-logic devices available to date have been digital (receiving and processing information in the form of discrete signals that are either "on" or "off"), because it is considered easier and less expensive to make such components. This factor has limited the use of fluid-logic in automatic control applications, because the latter usually involve continuous-variable analog inputs, such as voltage, resistance, position, etc.

It has been noteworthy that in the field of electronics the development of the silicon controlled rectifier as the most important member of the thyristor family of devices, has greatly simplified switching problems and eliminated the need for separate arrays of output interface devices and coordinating logic devices. As the above limitations indicate, there has been a parallel need to develop a similar thyristor-like device for the field of fluid logic. The present invention is such a device: a high-gain, gate-controlled, bistable, fluid-logic switch. It is prospectively as important a building-block element in practical fluid-logic circuits as has been the silicon controlled rectifier in electronics.

SUMMARY OF THE INVENTION

This invention comprises basically a three-way valve device with ports designatable as supply, cylinder and exhaust, to conform to classical pneumatics nomenclature. There is additionally a valving shaft: a single-moving-part structure connecting two valving elements, in such a way that, at the extreme possible positions of the valving shaft, the cylinder port is open when the exhaust port is closed, and vice versa. A "positive-pulse" push-rod is connectable to the cylinder port valving element (and a "negative-pulse" pull-rod is connectable to the exhaust-port valving element) so that a small mechanical force pulse delivered by such a rod will suffice, when the device is in so-called threshold mode to cause the valving shaft to suddenly shift to its opposite possible extreme position. This "sudden shift" is due to a kind of regenerative or positive feedback: Considering FIG. 1 of the drawings, it will be seen that as the conical poppet element (as one preferred kind of valving element) is slowly pushed off its seat by the application of a mechanical force on either a push- or pull-"gate-triggering" rod, a stream of fluid molecules will, due to the pressure differential between the chamber space above and below the poppet element, pass through the thus formed annular passage—resulting in a sudden pressure drop above the poppet such that any continued force on the rod at this time will now cause the valving shaft to accelerate upward, avalanching through regenerative (positive) feedback more fluid molecules downward through the now rapidly opening valve so that the device moves very rapidly into full forward conduction of the control-agent fluid.

It is assumed that the mechanical force on the gate rod will continue at least for such time as it takes to pressurize the cylinder chamber, so that such pressurization can now hold the exhaust-port poppet against its seat, thus latching the device in forward-conduction mode: the gate-triggering force can now be removed; since such latching typically occurs within a small fraction of a second (depending on inertia of the valving shaft, volume of the cylinder chamber, pressure differentials, or magnitude of the gate triggering force), the net force pulse delivered to the gate can be very brief.

Thus the central feature of the device comprising this invention is its bistable property, which in turn is due to the regenerative (positive) feedback phenomenon as described above. Most simply expressed, this is the snap-action, all-or-nothing property of the device which makes it valuable as a digital element in fluid-logic systems.

An important application of this invention is as an automatic control device wherein the gate-triggering push-rod (or pull-rod) of the fluid-logic thyristor is connected to an appropriate analog input sensor that transduces a continuous controlled variable into a mechanical-force signal which in turn is delivered at the control gate. "Two-position controller action" of the valving shaft implements closed-loop feedback control so that the system is self-regulating. One embodiment of the invention as an automatic control is seen in FIG. 8, depicting an automatic liquid-level regulator using a float attached to the push-rod as the analog input sensor, and a pressurizable ejection chamber (with connecting check valves) to facilitate pumping out liquid that entered by gravity. This particular automatic control would thus serve as a pneumatic ejector when the control-agent fluid is compressed air. A parallel embodiment of the invention would comprise a suction-pump system with vacuum attached to the exhaust port in lieu of atmospheric pressure. It will be noted that the existence in either pump system of but one single moving part, together with the fact that the constituent valving-shaft structure legs move through the exhaust air passageways, so that any heterogenous materials would be automatically air-purged, provides a long-term prospect of trouble-free operation.

The above automatic control application illustrates that although there is physically only one moving-part element in the present invention, the multiplicity of functions performed justifies its being labeled as an integrated-circuit device. This function-multiplicity is shown by noting the role-changing of the cylinder-port poppet-valve element during different parts of the operating cycle:

1. Analog-signal sensor-input termination point;
2. Analog-to-digital signal-conversion interface;

3. Control gate, during threshold mode;
4. Interaction region wherein regenerative feedback initiates and proceeds;
5. Differential force sensor—a logic-circuit element to decide when some command-signal or other predetermined input may be exceeded by the analog input signal, and to deliver such decision as an order to the control element;
6. Control-element output device, to vary the flow of control-agent fluid in measure as the thus-established closed-loop feedback control circuitry may determine and dictate.

DESCRIPTION OF THE PREFERRED EMBODIMENTS

Figure 5:
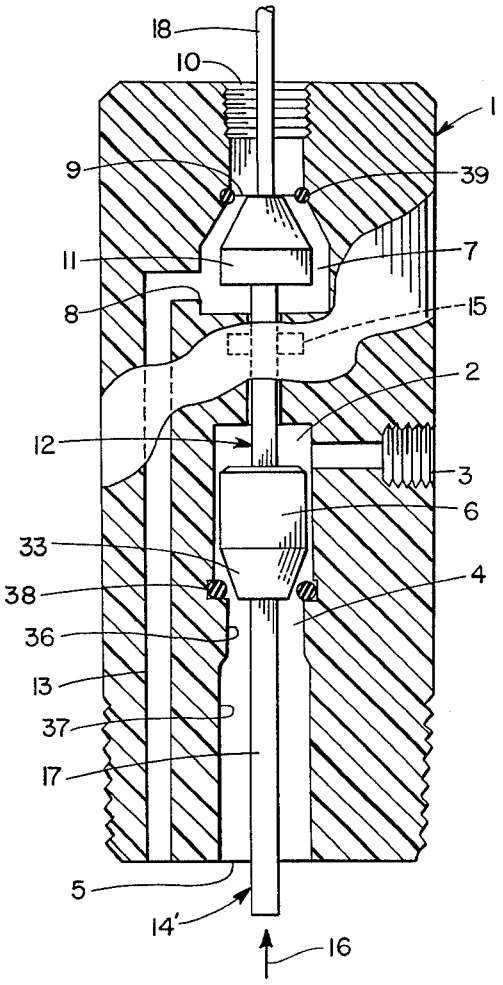
FIG. 5 is a cross-sectional view of another form of the fluid-logic thyristor.

The fluid-logic thyristor is a high gain gate-controlled latching switch device which consists of a housing 1 formed with a first chamber 2 having a supply port 3 and a first valve opening 4 and a cylinder port 5. A first valve member 6 is mounted for reciprocation within the first chamber between a first position in seating engagement with the first valve opening and a second position out of seating engagement with the first valve opening. A second chamber 7 is formed in the housing and has inlet opening 8, a second valve opening 9 and an exhaust port 10. A second valve member 11 is mounted for reciprocation within the second chamber between a first position out of seating engagement with the second valve opening and a second position in seating engagement with the second valve opening. Valve connecting means 12 operatively connect the first and second valve members for joint movement. Interconnecting passage 13 operatively connects the cylinder port and the exhaust port. Extension means 14' connect one of the valve members and a variable force means 16. When valve 6 opens, valve 11 closes. FIG. 5 illustrates the fluid-logic thyristor in its simplest form. Seal 15 prevents flow of fluid past connecting means 12.

Figure 1:
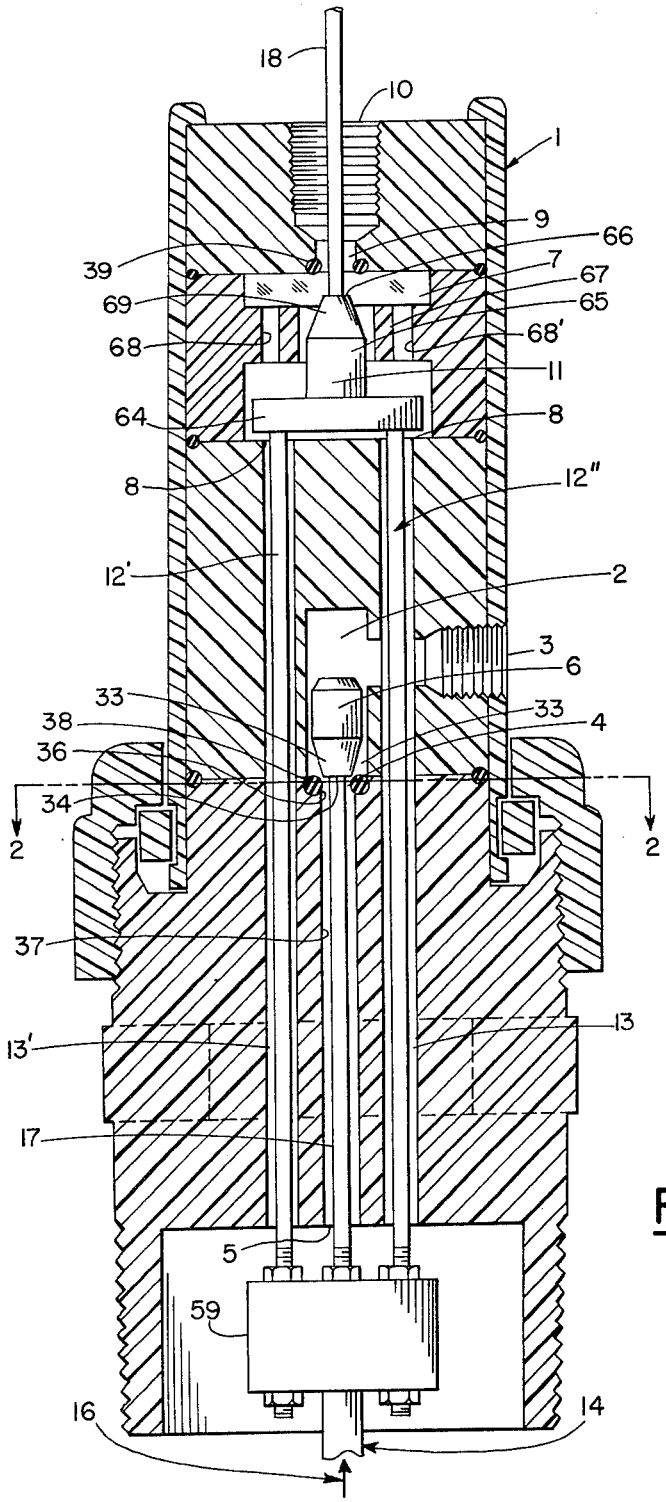
FIG. 1 is a cross-sectional view of a preferred embodiment of a fluid-logic thyristor.

Referring specifically to FIG. 1, a preferred form of the fluid-logic thyristor invention is illustrated. The extension means includes a first extension member 17 operatively connected to the first valve member and extends through the first valve opening and cylinder port for coupling the variable force means 16 to the first valve member. A second extension member 18 is operatively connected to the second valve member and extends through the second valve opening and the exhaust port.

Figure 2:
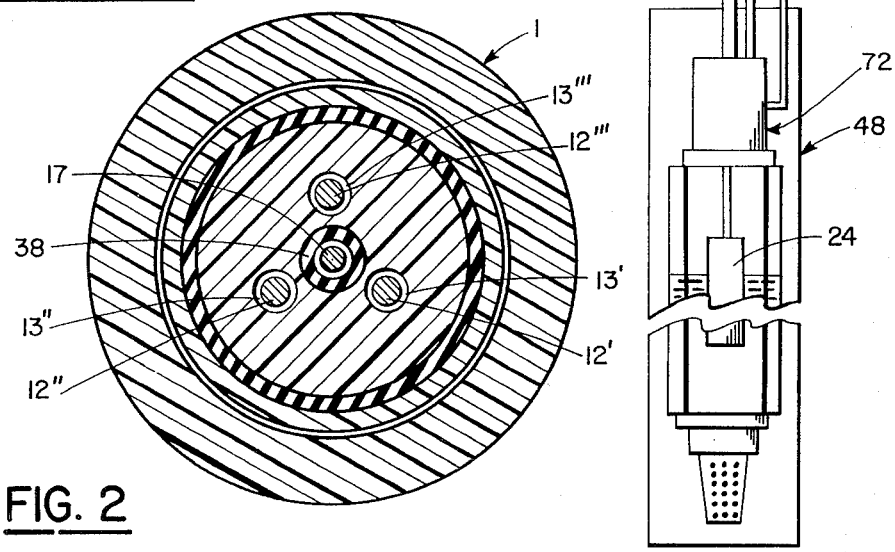
FIG. 2 is a cross-sectional view of the fluid-logic thyristor of FIG. 1 taken along line 2—2.
Figures 6, 7, 8:
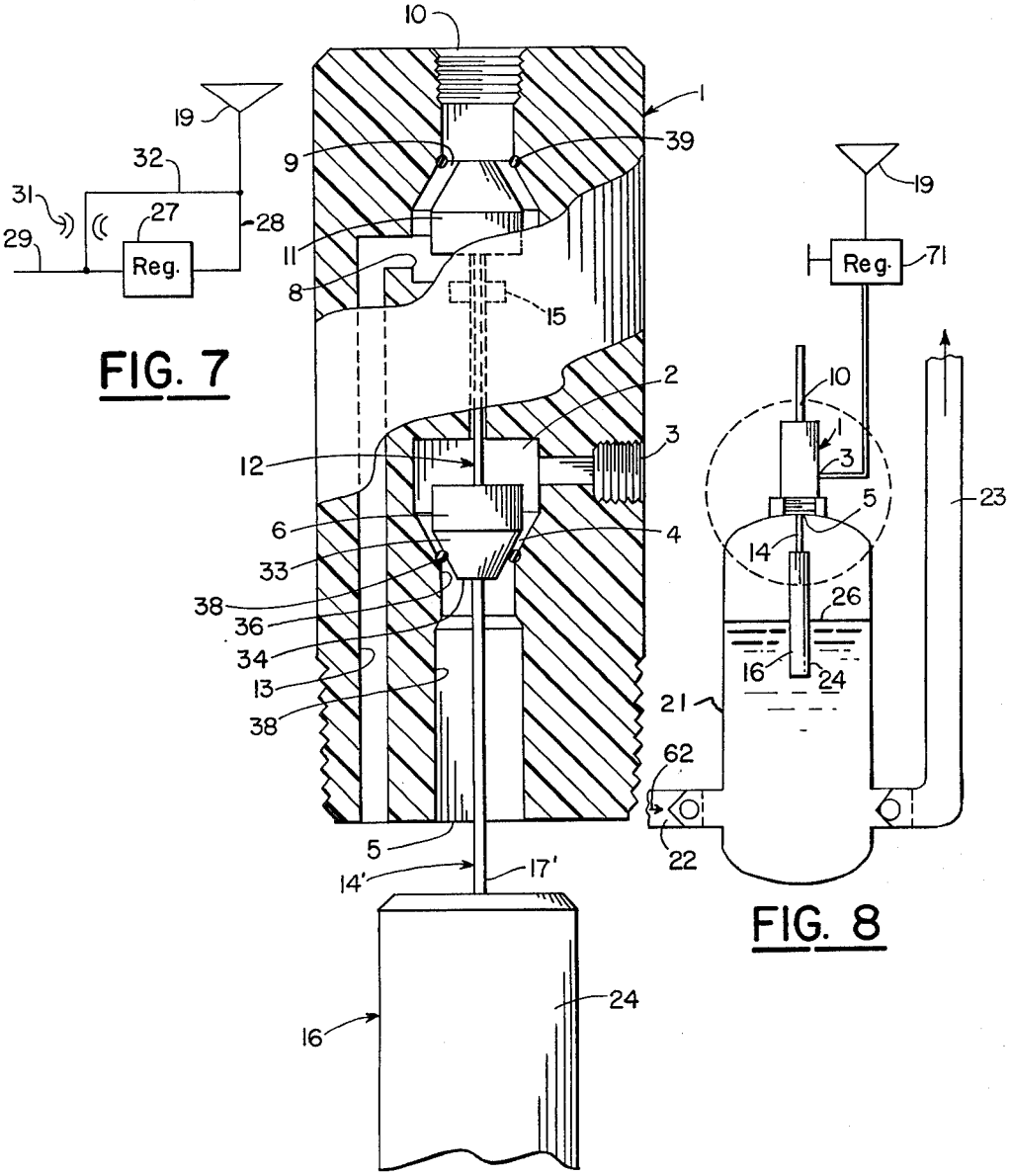
FIG. 6 is a cross-sectional view of another form of the invention.
FIG. 7 is a schematic of a system sometimes used in conjunction with the invention illustrated in FIG. 6.
FIG. 8 is a schematic of a system which uses the forms of the invention illustrated in FIGS. 3 and 6.

Referring specifically to FIGS. 2, 7 and 8, a pressure source means 19 is connected to the inlet port of the first chamber and a pressure container 21 is operatively connected to the cylinder port and the interconnecting passage 13.

In FIG. 8, the pressure container is formed with an inlet fluid passage 22 and an outlet fluid passage 23. A fluid source means such as a ground supply of water in a well supplies fluid to the inlet fluid passage in the pressure container. Float means 24 connected to the first valve member coacts with the fluid 26 in the pressure container to move the first valve in one direction by a buoyancy force and moves the first valve in the opposite direction by a gravity force.

In order to effect a snap action of the first and second valve members, a system as illustrated in FIG. 7 or a special configuration of the valve must be used. A pressure regulator 27 is connected to the pressure source 19 by line 28 and to the inlet port 3 of the first chamber by line 29. A flow constrictor 31 is connected to the pressure source 19 by line 32 and to the inlet port of the first chamber by line 29. Line 29 is connected to the pressure regulator and constrictor function to maintain a constant high pressure in the first chamber when the first valve member is in the first position in seating engagement with the first valve opening and a lower pressure when the first valve member is in the second position out of seating engagement with the first valve opening.

In order to obtain snap action of the valve members, without the system illustrated in FIG. 7, the first valve member is preferably formed with a head 33 having a blunt end 34. The blunt end is positioned approximately even with the beginning 36 of passage 37 when the head is seated on the O-ring 38. The purpose of the blunt end is to create a large unrestricted passage for the air entering passage 37 upon a slight movement of head 33 off the O-ring 38. Since a quick opening of the first valve and a quick closing of the second valve against O-ring 39 is essential to the operation of the device, the device may be used in combination with the system illustrated in FIG. 7. A blunt end and a valve angle of 17° also give the desired snap action results. The 17° finding is not a critical angle because the valve will give satisfactory, though less than perfect results in a range of somewhere between 7 and 37 degrees. The valve is shown installed in the device illustrated in FIG. 1 and previously described. The device of FIG. 11 may also use the valve shape illustrated in FIG. 10.

The device of the present invention may be used to pump the contents out of a container or to draw liquid into the container. The system illustrated in FIG. 8 illustrates the use of the device in pumping the contents out of a container while the systems of FIGS. 4 pump water into a container 51. In all systems the exhaust port 10 is connected to atmospheric pressure.

Where it is desirable to draw liquid into a container, the exhaust port 10 may be connected to a source of vacuum and the supply port 3 connected to atmospheric pressure or any higher pressure.

Figure 4:
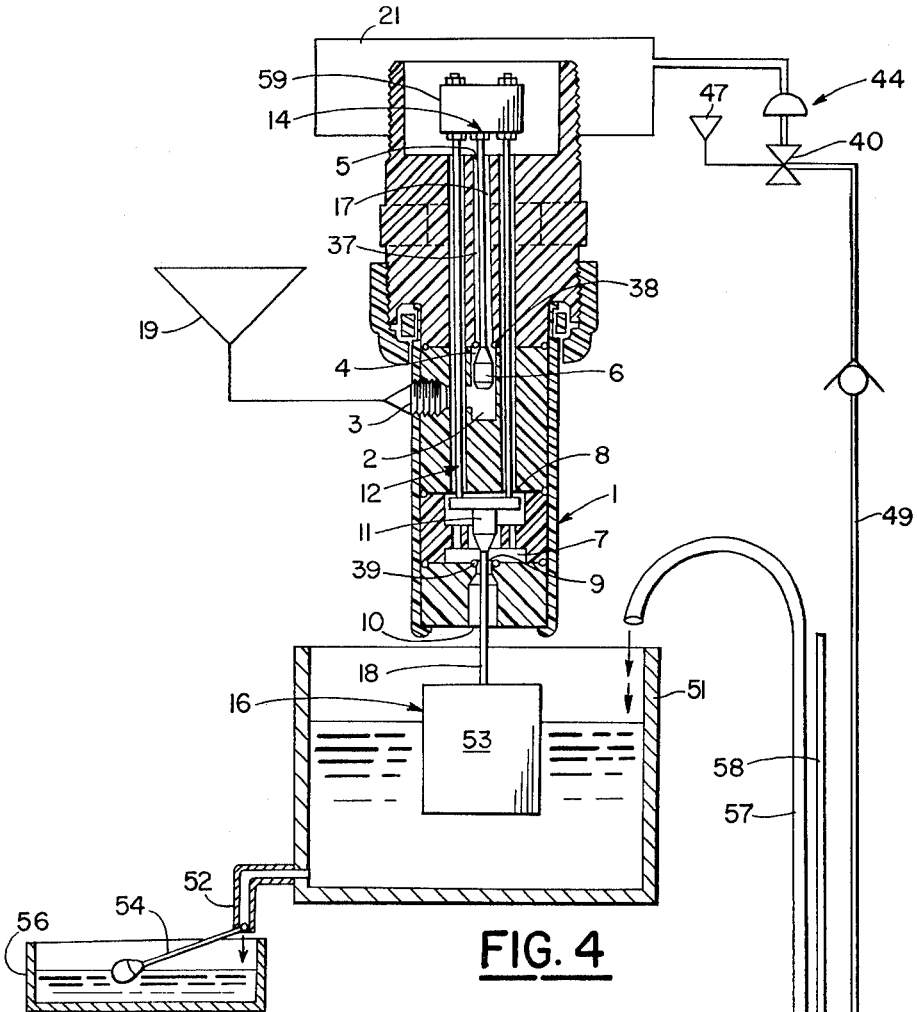
FIG. 4 is a schematic of an exemplary system using still another form of the invention.
Figure 9:
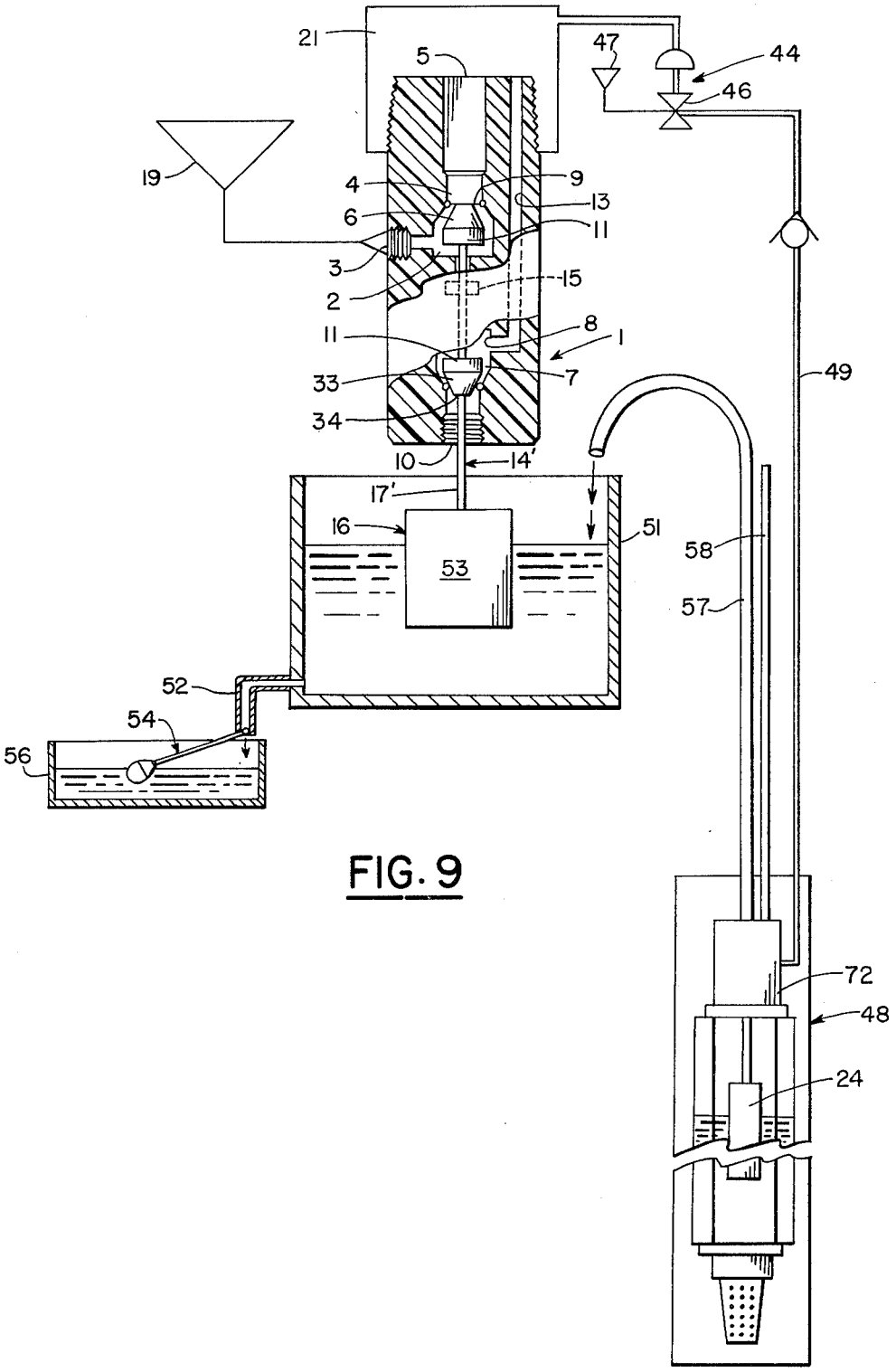
FIG. 9 is a schematic of an exemplary system using another form of the invention.

Another variation of the device is illustrated in FIGS. 4 and 9. In this form of the invention, the variable force means 16 is connected to the second valve member 11 and a fluid-pressure operated means 44 is connected to be in communication with the first valve member 6. The fluid-operated means is a 2-way fluid-operated valve 46. A second pressure source 47 is connected to and operable by the 2-way fluid-operated valve. A pump means 48 is adapted for connection to a well source of water. A fluid-pressure line 49 connects the second pressure source and the pump means. A fluid container 51 having a fluid outlet 52 is positioned above the well. The variable force means is a float member 53 connected to the second valve member 11 and is mounted for floating in the fluid container. Means for withdrawing fluid from the fluid container such as a float valve 54 is provided in a container such as a cattle trough 56. A conduit 57 connects the pump means and the fluid container 51. A conduit 58 carries exhaust fluid pressure to atmosphere.

FIG. 4 illustrates a system similar to the system illustrated in FIG. 9 but with the preferred form of the device. In this system, the housing 1 is formed with a first rod passage 37 which connects the first chamber 2 and the pressure container 21. The extension means 14 includes a coupler 59 and a first connecting rod 17 connected to the first valve member 6 and the coupler. The first rod passage 37 is formed with a cross section sufficient to receive the first connecting rod 17 for freely sliding reciprocation therein and for passage of pressurized fluid therethrough. The interconnecting passage includes a plurality of passages 13', 13'' and 13'''. The valve connecting means includes a plurality of rods 12', 12'', and 12''' mounted for reciprocation in the interconnecting passages and connected to the coupler 59. The interconnecting passages are formed with sufficient cross section to permit free sliding reciprocation therein and for passage of pressurized fluid therethrough.

Figure 10:
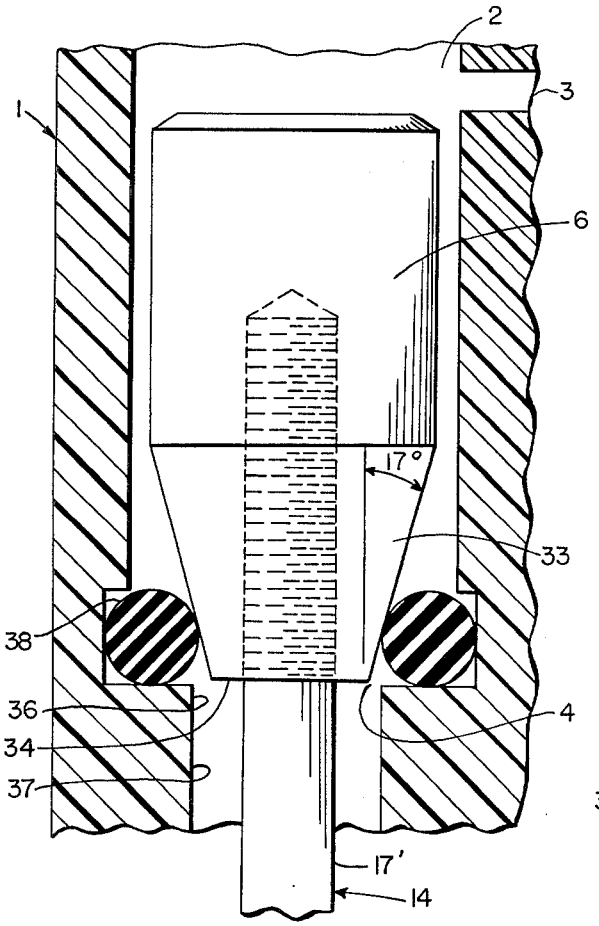
FIG. 10 is a cross-sectional view of one form of the first valve member.
Figure 11:
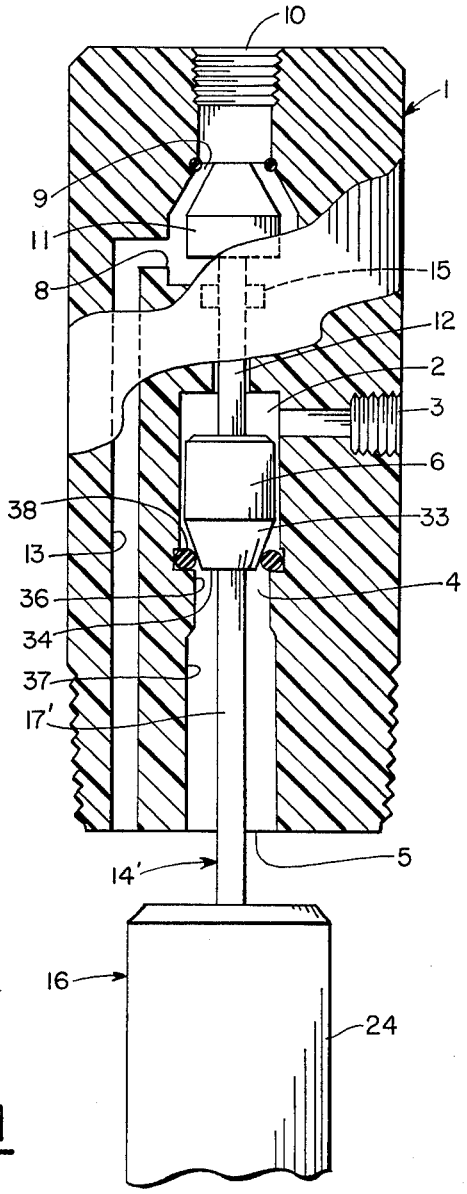
FIG. 11 is a cross-sectional view illustrating the use of the valve member shown in FIG. 5.

The preferred form of the fluid-logic thyristor is illustrated in FIG. 1. The extension means includes a push rod 14 connected to the coupler 59. A pull rod 18 is operatively connected to the second valve member 11 and extends through the second valve opening 9 and exhaust port 10. The fluid-logic thyristor will operate with a system as illustrated in FIG. 7, but preferably the first valve member is formed with a head having a blunt end as illustrated in FIG. 10. The head should also be formed as a truncated cone with an angle of approximately 17 degrees from the vertical and with a range of between approximately 7 and 37 degrees.

Second valve 11 may be formed with a ring 64 for receiving rods 12', 12'' and 12'''. The head 65 may have tapered walls 69 to fit within the O-ring 39 and have a blunt end 66. Guides 67 may be provided to guide the tapered head into seating engagement with the O-ring. Passages 68 and 68' provide unrestricted fluid flow between inlet openings 8 and valve opening 9.

Figure 3:
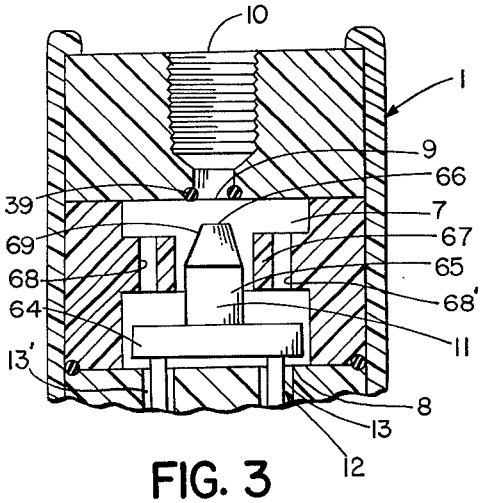
FIG. 3 is a cross-sectional view of a portion of another form of the invention.

An illustrative use of the preferred form of the invention is in pumping liquids as illustrated in FIG. 8 using the form of the invention illustrated in FIG. 1 as modified in FIG. 3. The device of FIG. 3 is identical to the device shown in FIG. 1 with the exception that the push rod 18 is removed from second valve 11. A pressure source means 19 is connected to the supply port 3. A pressure container 21 is operatively connected to communicate with the cylinder port 5 and the interconnecting passages 13', 13'', and 13'''.

The pressure container is formed with an inlet fluid passage 22 and an outlet fluid passage 23. A fluid source means 62 supplies fluid to the inlet fluid passage in the pressure container. A float means 24 is connected to the push rod 14 which coacts with the fluid in the pressure container to impact an upward buoyancy force on the first valve while a downward force is imported by gravity. The level of water in container 21 may be controlled by merely adjusting the air pressure at regulator 71.

The device illustrated in FIGS. 1 and 3 can be used to draw liquid out of a container by connecting a source of vacuum to the exhaust port 10 and connecting the supply port 3 to atmospheric pressure.

FIG. 4 illustrates a use of a modified form of the invention illustrated in FIG. 1 as modified by FIG. 3. In the system illustrated, the variable force means 16 is connected to the pull rod 18 and an air operated means 44 is connected to the cylinder port 5.

The fluid-operated means is a 2-way fluid-operated valve 40. A second pressure source 47 is connected to and operable by the 2-way fluid-operated valve 40. Pump means 48 is adapted for connection to a well source of water. A fluid-pressurized line 49 connects the second pressure source 47 and the pump means 48. A fluid container 51 has a fluid outlet 52. The variable force means is a float member 53 connected to the pull rod 18 and is mounted in the fluid container 51. Means 54 is provided for withdrawing fluid from the container. A conduit 57 connects the pump means 48 and the fluid container 51. The control module 72 may be the device illustrated in either FIG. 1 as modified by FIG. 3 or the device shown in FIG. 6. Float 24 is connected to push rod 14.

Operation of the thyristor of FIG. 1 is as follows. Fluid at a selected pressure enters supply port 3 and applies force on valve 6 to hold it seated against O-ring 38. When the force represented by arrow 16 acting on push rod 14 exceeds the weight of the first valve and its mechanism and the pressure acting on valve 6, the valve moves upwardly slightly. As a thin film of fluid passes between the O-ring 38 and the tapered portion 33 of the valve, the pressure in chamber 2 is quickly lowered and the valve moves rapidly. As more fluid rushes through the valve opening 4 there is a virtual "avalanche" or snap opening of the first valve. As the first valve moves, the extension member 17 pulls on the coupler 59, which in turn pushes on the valve connecting rods 12', 12'' and 12'''. Valve 11 is forced into seating engagement with O-ring 39 and fluid can no longer be exhausted through exhaust port 10. The valve is thus "latched" until an external force acts upon the push rod 14. The fluid-logic thyristor thus remains latched without further input from the push rod 14. Pressure from the pressure source will thus continue to pass through the cylinder port 5. The first valve is normally returned to the closed position by a force acting on push rod 14 exceeding the fluid pressure force on the second valve 11.

The system of FIG. 8 operates to pump water out of container 21. Either the device illustrated in FIG. 1 as modified by FIG. 3 or the device of FIG. 6 may be used. A pressure is selected at regulator 71 and fluid is supplied by source 19 to supply port 3. As the level of water rises in the container 21, the buoyant force acts on float 24. When the buoyant force exceeds the fluid pressure-force acting on first valve 6, the device avalanches and the first valve opens and the second valve closes the exhaust port 10. Fluid then enters container 21 and forces the water downwardly and up pipe 23. When the liquid level has fallen so that the weight of the float 24 overcomes the force holding the second valve closed, the second valve opens, the first valve closes and fluid can no longer enter the vessel 21. The fluid pressure is then exhausted through the exhaust valve 10 and water can enter again through pipe 22.

The system illustrated in FIG. 4 illustrates the versatility of the device. By in effect "inverting" the device of FIG. 1, the device can now be used to fill container 51 which is open to atmosphere. Float 53 senses the level of water in the container which may be used to supply a cattle trough 56. As the cattle drink from the container 56, the level drops and a float valve 54 releases water from tank 51. When the level in tank 51 drops below a predetermined level, the weight of float 53 pulls the second valve 11 downwardly so that it seats on O-ring 39. The valve-connecting rods 12, coupler 59 and extension member 17 (all sometimes collectively referred to as the "milk stool") are pulled downwardly, thereby opening first valve 6. Fluid from pressure source 19 passes out cylinder port 5 and actuates two way valve 40 which in turn actuates second fluid pressure source 47. Fluid passes to a deep well pump which has a control module like the device illustrated in FIG. 1 as modified by the device illustrated in FIG. 3. Water is pumped up pipe 57 until the well runs temporarily dry which results in the water level receding to a point that float 24 drops and closes a first valve, and the fluid is exhausted through an exhaust port and through pipe 58, as previously explained in the operation of FIG. 1. The pumping will stop when float 53 due to the rise in liquid level causes valve member 6 to close, thus cutting off the fluid supply from source 19 to 2-way valve 40.

Operation of the pumping system in FIG. 9 is identical to the system of FIG. 4 except that the fluid-logic thyristor is the same as that illustrated in FIG. 6 the operation of which has previously been explained.

A GLOSSARY

| CODE: | REFERENCE: |
|---|---|
| Fit | E. C. Fitch & J. B. Surjaatmadja, INTRODUCTION TO FLUID LOGIC, Hemisphere Publ. Corp. (McGraw Hill, 1978) |
| GE | Gutzwiller et al (ed.), SCR MANUAL, 4th Edition, General Electric Co. (1967) |
| Graf | Rudolf F. Graf (ed.), DICTIONARY OF ELECTRONICS, Howard Sams Co. (1974) |
| Marks | T. Baumeister & L. S. Marks (editors), STANDARD HANDBOOK FOR MECHANICAL ENGINEERS, McGraw-Hill Book Company (1967) |
| MW | P. Gove et al (ed.), WEBSTER'S UNABRIDGED DICTIONARY G. & C. Merriam Company (1961) |
| NFPA | T. M. Weathers (ed), WHAT YOU SHOULD KNOW ABOUT FLUIDICS, National Fluid Power Association, Inc. (1972) |
| P/B | C. D. Pinkstaff & P. M. Engstrom, DIGITAL AIR CONTROL WITH FLUIDIC AMPLIFIERS, Pitney Bowes Fluidic Controls (1971) |
| * | Single asterisk following a code reference indicates that the definition is primarily taken from the indicated source, but has been modified. |
| ** | Double asterisk indicates that the definition is new. |

ACTIVE ELEMENT

An element that has one of its passage ports connected to a power source. (Fit*)

AUTOMATIC CONTROL

A control system that produces a desired output when inputs to the system are changed. Such inputs are in the form of command signals which the output is expected to follow, and disturbances, which the automatic control is expected to minimize. (Marks*)

AUTOMATIC REGULATOR

An apparatus which measures the value of a quantity or condition which is subject to change with time, and operates to maintain within limits this measured value. (Marks)

BISTABLE

A circuit element with two stable operating states—e.g., a flip-flop in which one transistor is saturated while the other is turned off. It changes state for each input pulse or trigger. Of or pertaining to the general class of devices that operate in either of two possible states in the presence or absence of the setting input. (Graf)

CIRCUIT

An assemblage of elements and their interconnection. (Fit)

CLOSED-LOOP FEEDBACK CONTROL

A kind of automatic control which, in the presence of a disturbing influence, tends to reduce the difference between the actual state of a system and an arbitrarily varied desired state and which does so on the basis of the difference. (Marks)

COMMAND SIGNAL INPUT

A primary-input signal which is established or varied by some means external to, and independent of, the feedback control system under consideration. (Marks*)

CONTROL AGENT

Process energy whose flow is directly varied by the control element. (Marks)

CONTROL ELEMENT

In a control system, a valve or switch to vary the flow of a control agent in response to commands from a logic element. (**)

CONTROL GATE OF ELECTRONIC THYRISTOR

That portion of a PNPN-device contiguous to the gate electrode where the temporary (short-pulse) injection of additional "gate" current carriers into the transistor-base region of the device results in an increase in the energy of the (leakage) current carriers arriving at the collector junction. This increase is sufficient to dislodge additional carriers, and these carriers in turn dislodge more carriers—and the whole junction goes into a form of regenerative-feedback induced avalanche condition characterized by a sharp increase in forward conduction of the control agent (collector current): the thyristor (SCR or SCS) has been turned on and will remain latched on even after the gate-triggering current has been removed, assuming that certain events (such as Reverse voltage) are not allowed to occur. (GE*)

CONTROL GATE OF FLUID-LOGIC THYRISTOR

That portion of the cyllinder port or exhaust port sealable by part of the valving control element but also connectable to a gate-trigger. The latter is typically either a ("positive-pulse imparting") push-rod at the cylinder-port, or a ("negative-pulse imparting") pull-rod at the exhaust-port. When an appropriate bias force has been pre-set (as by a command-signal input, typically to one of the two conical poppet elements as depicted in FIG. 1 to oppose a present position of the valving shaft, the device is in threshold mode and will require only a very small force imparted to the control gate to trigger it over into its opposite state. As the poppet-valve portion of the valving shaft starts to lift off its seat ("crack open"), and an initial thin stream of gas molecules slips by the valve, the pressure above the valve will begin to drop, lessening the force opposing the gate-triggering force, and the valve will open further, creating a regenerative-feedback-induced avalanche condition characterized by a sharp increase in forward conduction of the control agent (compressed air): the thyristor has been turned on and will remain latched on even after the gate-triggering force has been removed, assuming that certain events (such as too-low pressure) are not allowed to occur. (**)

CONTROL SYSTEM

A system consisting of the control network, input sensors, and outputs. (Fit)

CONTROLLED VARIABLE

That quantity of condition of the controlled system which is directly measured or controlled. (Marks)

DIGITAL

Relating to discrete operations or systems. (Fit)

ELEMENT

A device used to achieve a given function. (Fit)

FEEDBACK

A condition where a secondary or primary output of a system becomes an input to the system itself. (Fit)

FEEDBACK INPUT

Input that indicates the completion of a certain machine operation. (Fit)

FLUIDIC

Relating to nonmoving part fluid elements. (Fit)

FLUID LOGIC

The study of a system utilizing digital conrol elements and circuits that uses fluids (liquids or gases) to transmit logic signals. (Fit)

Fluid logic is the study of digital-type fluid control elements and the interconnection of such elements to satisfy a given logic specification. Fluid logic circuits utilize a particular class of control elements which possess discrete states. The primary purpose of the fluid logic circuit incorporating these elements is to accomplish a control function rather than a power transmission service.

In fluid logic, a fluid (either a liquid, a gas, or both) is used to transmit signals and perform the logic function. Although hybrid systems (those involving other signal media such as mechanical and electrical) are common, a pure fluid system would exhibit fluid inputs, outputs, and circuit elements. Fluid-logic elements include both fluidic (nonmoving-parts hardware) and those having moving parts such as diaphragms, membranes, balls, and spools. When the logic specification is simple and involves low power levels, the use of fluidic elements has proved rewarding. However, in complex logic networks, the use of air logic (miniaturized, modularized moving-parts-type pneumatic elements) is almost mandatory. (Fit)

GAIN

The ratio of increase of output power, current or voltage over input, as in an amplifier. (Graf)

The gain of an active element is the ratio of output-signal magnitude to input-signal magnitude. (NFPA*)

The gain of a thyristor is the ratio of the magnitude of the secondary-output to the magnitude of the gate-trigger signal. (**)

GATE ELECTRODE

A control electrode to which trigger pulses are applied. (Graf)

GATE TRIGGER

In a thyristor, a second input signal delivered to the control gate when the device is in threshold mode. (**)

HYBRID

Characterizing a fluid-logic control system that involves mixed signal media (such as mechanical, electrical, fluidic) and elements which may comprise a combination of moving-parts and nonmoving-parts hardware. (**)

INPUT

A signal used to represent the state of a particular condition. (Fit)

See also the following entries:
COMMAND SIGNAL INPUT
FEEDBACK INPUT
PREDETERMINED INPUT
PRIMARY INPUT
SECONDARY INPUT

INPUT SENSOR

A device used to produce inputs. (Fit)

Input sensors produce input signals relating to the status of the machine or process being controlled and initiate instructions to the control system in the form of input signals to the logic (decision making) portion of the system. Types of input sensors include air sensors, acoustic sensors, sensor relays, manual panel operators, electrofluidic interfaces. (P/B*)

INTEGRATED CIRCUIT (I-C)

A combination of interconnected circuit elements inseparably associated on or within a continuous substrate. Any device in which both active and passive elements are contained within a single package. (Graf)

Any device in which physically inseparable components may perform more than one function or serve as more than one element, and wherein some logic function is either "built in" with, or is already physically an indispensable part of the sensing (input sensor) and/or actuating (output device) functions. Some examples follow: (**)

FLUIDIC BOW THRUSTER FOR SHIPS. This device represents the application of the "wall-attachment phenomenon" . . . . In this case there is essentially no interface between the fluidic output signal and the desired actuating force. The input signal (which in this case usually comes from a manually actuated valve of some sort) influences the main power stream of fluid directly. The resulting change in the direction of flow of the bow thruster fluid stream provides the desired side thrust on the bow of the vessel by jet reaction (Newton's Third Law). (NFPA*)

LOW VELOCITY WIND SPEED SENSOR. This is a non-moving parts device which measures air flow velocity from 0.3 to 160 feet per second with high accuracy. It utilizes the turbulence amplifier operating principle, wherein a laminar supply stream flow is measurably interrupted by an input control signal (the wind) before reaching a collector port. (NFPA*)

THYRISTOR (Electronic or Pneumatic). The inseparability of respective elements (input sensor, logic element, output device, terminal or port to admit the control agent) is illustrated by consideration of the role-changing that occurs at the interaction region: the mechanism of the control gate, as a separate and discrete element serving to deliver an input signal into the interaction region when threshold mode has been achieved, totally disappears after the gate has been triggered and the device is avalanched into full forward conduction of the control agent.

INTERACTION REGION

That region within an active-element device which, in communication with the ports or terminals of the device, provides the locus of intermediation between input signals and the control agent (power supply) in order to facilitate some change in output from the device. (**)

Some examples:

IN A THYRATRON:

The interelectrode hot-cathode gas space surrounding the grid control electrode(s) between cathode and anode (plate). (Graf*)

IN A SILICON CONTROLLED RECTIFIER:

The lower p-base portion of the pnpn semiconductor structure wherein regenerative (or positive) feedback initiates, and wherein (assuming threshold mode) the introduction of a small current pulse will cause the feedback loop gain to rise to unity, thus triggering the avalanche condition (discussed under control gate of electrode thyristor) and forward conduction. (**)

IN A FLUID-LOGIC THYRISTOR:

The region containing the seated valving element as well as the gas space on each side of that element, together with the control gate of the fluid-logic thyristor, wherein (assuming threshold mode) the introduction of a small force pulse will yield a net valve-cracking force, thus triggering the avalanche condition (discussed under control gate of fluid-logic thyristor) and forward conduction. (**)

INTERFACE

A device that serves as a boundary between two different signal transmission media. (Fit)

LATCH

A feedback loop used in a symmetrical digital circuit (such as a flip-flop) to retain a state. The latch is a simple logic storage element. (Graf)

LATCHING RELAY

A relaly with contacts that lock in either the energized or de-energized position, or both, until reset either manually or electrically. (Graf)

LOGIC

Relating to reason and decision-making. (Fit)

LOGIC CIRCUITRY

In any control system, the decision-making function and the communication thereof to an output device in order to provide power to perform useful work. (**)

LOGIC CIRCUITRY IN A THYRISTOR

In a thyristor, wich should be regarded as an integrated-circuit device, the logic element comprises that portion of the interaction region wherein the magnitude of the gate signal (as a secondary input) is additively compared with the magnitude of the primary input (command signal, bias signal, or reference standard). If the logic element determines that the magnitude of the gate signal exceeds that of the net primary input, then an instruction issues to the output-element portion of the thyristor I-C to commence forward conduction. (**)

In the case of an SCR, the actual value of the incoming DC gate current is thus compared with Igt, the forward gate current required to trigger a given electronic thyristor at stated temperature conditions. (**)

In the case of a pneumatic thyristor, the vector magnitude of the force pulse imparted by the push- or pull-rod connected with the control gate is additively compared with the vector magnitude of the primary input (comprising opposing air-pressure force imparted on the opposite side of the valving element; weight of the valving shaft; any adjustable or non-adjustable command-signal bias forces due to springs or other means). (**)

LOGIC ELEMENT

A device that is capable of making a true or false, yes or no, "I" or "O" output decision, based upon its input condition. (Fit)

NETWORK

An assemblage of circuits and their interconnection. (Fit)

OUTPUT

A signal used to represent the external state of a system. (Fit) (See also PRIMARY OUTPUT).

OUTPUT DEVICE

An output device converts low-level fluidic signals into usable energy form for controlling cylinders, valves, motors or other work producing elements. Types of output devices include power amplifiers, fluidic-electric interfaces, information displays. (P/B)

PASSIVE ELEMENT

An element that has none of its ports connected to a power source. (Fit*)

PNPN (four-layer) DIODE

A semiconductor device which may be regarded as a two-transistor structure with two separate emitters feeding a common collector. This combination constitutes a feedback loop which is unstable for loop gains greater than unity. The instability results in a current which increases until ohmic circuit resistances limit the maximum value. This gives rise to a negative-resistance region which may be utilized for switching or for waveform generation. (Graf)

PREDETERMINED INPUT

An input generated as a result of a fixed sequence of events. (Fit)

PRIMARY INPUT

An input from an external source to a control network source in a medium compatible with the network. (Fit)

PRIMARY OUTPUT

An output that is used for the control of a machine. (Fit)

PULL ROD

The negative-pulse gate-trigger mechanical element connectable at the exhaust-port end of the valving shaft; cf. control gate of fluid-logic thyristor.

PUSH ROD

The possitive-pulse gate-trigger mechanical element connectable at the cylinder-port end of the valving shaft; cf. discussion under control gate or fluid-logic thyristor.

REGENERATIVE (or POSITIVE) FEEDBACK

The process by which part of the power in the output circuit acts upon the input circuit to increase the amplification. (MW)

The gain in power obtained by coupling from a high-level point back to a lower-level point in an amplifier or in a system which encloses devices having a power-level gain. (Graf)

Cf. use of the term avalanching under control gate or fluid-logic thyristor, and also under control gate of electronic thyristor.

SECONDARY INPUT

An input produced by the control network itself. (Fit)

SECONDARY OUTPUT

An output used to reflect the present state of a machine. (Fit)

SELF-REGULATION

That operating characteristic which inherently assists the establishment of equilibrium. (Marks)

SENSOR

An element which transforms a state property into a signal. (Fit)

SIGNAL

A detectable physical quantity or impulse representing the state of a system. (Fit)

SILICON CONTROLLED RECTIFIER (SCR)

The SCR is a undirectional thyristor device (i.e., current flows from anode to cathode only) with three terminals (anode, cathode and control gate). It is therefore classified as a reverse blocking triode thyristor. (GE*)

A four-layer pnpn semiconductor device that, when in its normal state, blocks a voltage applied in either direction. The device is enabled to conduct in the forward direction when an appropriate signal is applied to the gate electrode. When such conduction is established, it continues even with the control signal removed until the anode supply is removed, reduced, or reversed. The SCR is the solid-state equivalent of the thyratron tube. (Graf)

SILICON CONTROLLED SWITCH (SCS)

A four-terminal pnpn semiconductor switching device; it can be triggered into conduction by the application of either a positive or negative pulse to the appropriate gate electrode. (Graf*)

SYSTEM

A collection of elements united by some form of interaction. (Fit)

THRESHOLD MODE

That state or condition characterizing the interaction region of a thyristor immediately before a minimum input signal pulse can succeed, on arriving at the control gate, in triggering the device into full forward conduction. (**)

THYRATRON

A gas-filled, three-element, hot-cathode tube in which the grid controls only the start of a continuous current thus giving the tube a trigger effect. (MW)

A hot-cathode gas tube in which one or more control electrodes initiate the anode current, but do not limit it except under certain operating conditions. (Graf)

THYRISTOR (Electronic)

A bistable device comprising three or more junctions. At least one of the junctions can switch between reverse- and forward-voltage polarity within a single quadrant of the anode-to-cathode voltage-current characteristics. (Graf)

Any semiconductor switch whose bistable action depends on PNPN regenerative feedback. Thyristors can be two-, three- or four-terminal devices, and both unidirectional and bidirectional devices are available. (GE)

Some examples of thyristors:
SILICON CONTROLLED RECTIFIER (SCR)
SILICON CONTROLLED SWITCH (SCS)

THYRISTOR (Pneumatic)

As an analogue to the electronic thyristor, any hybrid device whose bistable action depends on avalanching, regenerative (positive) feedback. (**)

As an analogue to that particular electronic thyristor known as the silicon controlled rectifier (SCR), the pneumatic thyristor is a hybrid, bistable fluid-logic switching device that in its normal state blocks forward conduction of the control-agent fluid. The device is enabled to conduct in the forward direction when an appropriate mechanical signal is applied to a control gate. When such conduction is established it continues even with the control signal removed, until the control-agent supply flow is removed, reduced or reversed. (**)

(The pneumatic thyristor is the fluid-logic equivalent of the electronic thyristor in general and the SCR in particular: the basic description of the latter two electronic devices parallels the language in the above two paragraphs. See in this glossary thyristor (electronic) and silicon controlled rectifier.) (**)

In a fluid-logic circuit, the pneumatic thyristor functions typically as a three-way valve which in its normal blocked state has zero forward conduction (cylinder is blocked to supply but open to exhaust), but which can be actuated and latched into full forward conduction (cylinder open to supply, blocked to exhaust) by means of a single force pulse mechanically delivered to one of the two control gates. Such forward conduction will continue even after the force pulse is discontinued and can normally be stopped only if an opposite mechanical force pulse is delivered to one of the two control gates. (**)

TWO-POSITION CONTROLLER ACTION

That in which the final control element is moved immediately from one extreme to the other of its stroke, at predetermined values of the controlled variable. (Marks)

TRANSDUCER

A device actuated by power from one system and supplying power in the same or any other form to a second system. (MW)

VALVING SHAFT

In a pneumatic thyristor, the single-moving-part structure connecting the positive-pulse gate-triggering push-rod with the negative-pulse gate-triggering pull-rod, incorporating also the two valving elements in such a way that one valve is open while the other is closed. (**)

I claim:

1. A fluid-logic thyristor comprising:

a housing formed with a first chamber having a supply port adapted for communication with a source of fluid pressure, a first valve opening, and a cylinder port;

a first valve member mounted for reciprocation within said first chamber between a first position in seating engagement with said first valve opening and a second position out of seating engagement with said first valve opening and located between said source of fluid pressure and said first valve opening so that valve closure is facilitated by said fluid pressure;

a second chamber formed in said housing having an inlet opening, a second valve opening, and a exhaust port;

a second valve member mounted for reciprocation within said second chamber between a first position out of seating engagement with said second valve opening a second position in seating engagement with said second valve opening located between said source of fluid pressure and said second valve opening so that valve closure is facilitated by said fluid pressure;

valve-connecting means operatively connecting said first and second valve members for joint movement;

an interconnecting flow passage operatively connecting said cylinder port and said exhaust port; and extension means connected to one of said valve members and adapted for connection to a variable force means;

said housing being formed with a first rod passage connecting said first chamber and said cylinder port;

said extension means including a coupler and a first connecting rod connected to said first valve member and coupler;

said first rod passage being formed with a cross section sufficient to receive said first connecting rod for freely sliding reciprocation therein and for passage of pressurized fluid therethrough;

said interconnecting passage including a plurality of passages;

said valve connecting means including a plurality of rods mounted for reciprocation in said interconnecting passages and connected to said coupler;

said interconnecting passages being formed with suffient cross section to permit free sliding reciprocation of said rods therein and for passage of pressurized fluid therethrough.

2. A fluid-logic thyristor as claimed in claim 1 wherein:

said extension means includes a push rod connected to said coupler; and a pull rod is operatively connected to said second valve member and extends through said second valve opening and said exhaust port.

* * * * *